United States Patent [19]

Wengmann et al.

[11] Patent Number: 4,900,010

[45] Date of Patent: Feb. 13, 1990

[54] ATHLETIC FIELD AND PLAYGROUND

[76] Inventors: Bernd Wengmann, Niederwiesstrasse 17c, CH-5417 Untersiggenthal; Ernst Habegger, Kirchbühlstrasse 2, CH-3515 Oberdiessbach, both of Switzerland

[21] Appl. No.: 261,168

[22] Filed: Oct. 21, 1988

[30] Foreign Application Priority Data

Oct. 29, 1987 [CH] Switzerland ..... 4242/87

[51] Int. Cl.[4] ..... E01C 13/00

[52] U.S. Cl. ..... 272/3; 47/1.01; 405/36; 405/45

[58] Field of Search ..... 272/3–5; 405/36, 45, 258; 52/169.5, 742; 47/1 R, 58; 264/37; 523/129; 524/79; 521/99; 428/17, 314.4, 314.8, 316.6, 319.1

[56] References Cited

U.S. PATENT DOCUMENTS

Re. 32,476 8/1987 Kistner ..... 404/264
4,679,963 7/1987 Heath ..... 272/3 X

FOREIGN PATENT DOCUMENTS 96908 12/1983 European Pat. Off. ..... 272/3
3138494 4/1983 Fed. Rep. of Germany ..... 272/3
200475 5/1983 German Democratic Rep. .... 272/3

*Primary Examiner*—Richard E. Chilcot, Jr.
*Attorney, Agent, or Firm*—Wigman & Cohen

[57] ABSTRACT

An athletic field or playground having an essentially planar surface consisting, at least in part, of tree bark particles consolidated to form an essentially tread resistant top layer of the athletic field or playground; the top layer consists, at least predominantly, of a mixture of particulate tree bark and of flexible fibers dispersed in the mixture; an at least predominant portion of the fibers has a fiber length that is greater than the average largest dimension of the tree bark particles. Natural or synthetic fibers may be used in the mixture if their rot resistance is at least about that of the tree bark particles, and coconut fibers each having a length of at least about 2 inches and used in a proportion of from about 0.01 to 10%, based upon the dry weight of the tree bark, are a typical example.

Construction and maintenance costs of such fields are low when compared to fields having a top layer of natural or manmade grass, and neither the impact of heavy rain showers nor of the most intensive use will diminish the most favorable properties regarding player safety and comfort.

17 Claims, No Drawings

ATHLETIC FIELD AND PLAYGROUND

BACKGROUND OF THE INVENTION

1. Field of the Invention

The present invention relates to open-air fields for use as athletic fields, ballgame fields or playgrounds.

Open-air fields, i.e. those having no means for excluding rain or snowfall and yet can be used for athletics, ballgames etc. under all normal weather conditions must meet two basic requirements: they must be capable of being used even in rain showers, or very shortly after a heavy rain fall, substantially without formation of water puddles on the field and without the surface losing its tread-resistant properties. The term "tread resistance" as used herein indicates the property of a field surface to withstand being tread upon by the feet of athletes, players or mounts without substantial damage and without impairing normal motion of players, animals or sporting devices.

Further, while such surfaces must be tread-resistant, they should not cause injuries to players falling to, or sliding on, the ground by accident or intention. Firstly, this implies selective resilience of the top layer of the field in the sense of softening the impact of a falling player while providing sufficient rebound to the feet of running players or horses, as well as to sporting devices, such as pneumatic balls. Secondly, this implies a relatively low surface friction in the sense that the unprotected skin of a player sliding along the ground under a forward momentum will be neither abraded, as is the case with sand or ash surfaces, nor burnt, as is the case with some plastic surfaces.

Typical games that would benefit from fields that satisfy these requirements include football, field handball, soccer, baseball, rugby, hockey, polo and other games conventionally played by opposing teams on open-air fields. Generally, the term "athletic field" as used herein is intended to include fields which are, or can be, used temporarily or exclusively for ball games of the types indicated above including team training.

2. Description of the Prior Art

Two main categories of open-air fields are defined by the mechanisms involved in getting rid of water that might accumulate at the upper surface of the field: the top layer either prevents or permits vertical passage of water. Hence, the top layer of the former category is substantially impermeable to water, e.g. due to an essentially continuous matrix or stratum of a water-impervious material, such as bitumen or plastics, and the surface water is removed by surface flow caused on account of a light inclination of the surface by means of water-collecting channels and openings in the surface or in lateral areas thereof. The second or water-permeable type of top layers of athletic or ball game fields permits an essentially instantaneous vertical passage of surface water, i.e. at a vertical flow rate that is commensurate with normal rain intensity, expressed, for example, in milliliters per square meter per minute; in this second category, water puddles must not form, or must disappear within minutes or even seconds after a heavy shower. By the same token, water produced by melting of a snow layer on top of the field's surface must be able to permeate the field's top layer without substantial accumulation near the surface since this would promote microbiological growth on, or decay of, components of the top layer.

The present invention is concerned with the second or water-permeable type of top layers. Since the water permeability of the top layer is but a part of the overall permeability of a normally multi-layered open-air field structure, it goes almost without saying that the substratum below the top layer must be capable to absorb or pass water at the maximum rate of its permeation through the top layer. This, however, is conventional and can be achieved by drainage systems, e.g. perforated pipes arranged in a sub-stratum and communicating with a suitably dimensioned outlet and/or pumping mechanism.

Conventional water-permeable top layer structures include grass fields both of the natural as well as the synthetic type; while natural grass has some self-repair capacity, this requires time and care. Generally, natural grass fields do not support continuous (e.g. daily) use and require a very substantial maintenance effort. Hence, maintenance costs and allowable use intensity tend to severely limit their application for heavy use.

Fields of synthetic grass, i.e. those formed of man-made polymer structures resembling the structure of natural grass, on the other hand, require less maintenance and support heavy use but are very costly as regards production. Further, they tend to cause severe abrasions or burns of unprotected skin portions of players that slide on the field after a fall, tackle or the like ground contact.

The third general category of water-permeable open-air fields has a top layer formed of an essentially granular material, such as sand or mineral ash, in a more or less densely compacted form. Obviously, the degree of tread resistance and hardness will depend upon the particular use and a tennis field, for example, may require a somewhat different surface quality than a field used for soccer training.

Basic general structures are defined, for example, in German Industrial Standards (DIN 18035/1973) and such standards may be consulted not only for proper selection of conventional mineral top layers but also for suitable substrata structures of use for organic top layers of the type contemplated by the present invention.

Generally, conventional "sand-top" or "hard-top" mineral top layer structures (German: "Tennenplätze") for athletic or ball game fields are less expensive in construction and maintenance but have the severe common disadvantage of causing bone fractures, contusions and large abrasions when used for athletics or ball games which involve much ground contact of the players' bodies As a consequence, fields with mineral top layers are sometimes used for ball game training but actual competitions are generally played but on natural or synthetic grass fields.

Sporting surfaces for ski slopes in the form of undercovering layers beneath natural or artificial snow have been disclosed in U.S. Patent No. 3,427,934 to Zames who suggests to use particulate tree bark for forming a cover on an underlying sub-stratum of grass and rocks to reduce the degree of natural irregularities for a ski track that will be formed by the snow cover on the tree bark layer. Tread resistance is not an issue here, however, nor is water permeability.

Further, tree bark material is conventionally used as a top layer material for jogging tracks, horse training grounds and childrens' playfields but is not, per se, normally suitable for athletic or ball game fields that require a substantial tread resistance. However, tread resistance can be increased by ordered deposition of a generally platelet-shaped tree bark material and/or by the use of permanent or temporary binding agents including water.

A top layer of particulate tree bark for soccer fields with improved tread resistance is disclosed in Applicants' European Patent Specification No. 0 096 908 involving a two-layered top structure formed of tree bark materials of differing particle sizes including a lower layer having a coarser texture and an upper layer having a finer structure.

While natural components of tree bark, notably tannins, tend to reduce or minimize natural decomposition of the particles under ambient conditions and in the presence of natural microbiological organisms and humidity, such decomposition cannot be totally precluded in practice, not even when using additional stabilizing agents because the latter would be leached out eventually, aside from undesirable environmental effects of such additives. Natural biological decomposition of an organic material is generally termed "rot" and the resistance of a given material against such decomposition is termed "rot resistance" herein. Specific methods for quantifying this parameter are known in the art and will be briefly explained in connection with the examples herein. By the same token, the extent to which a given organic material has been decomposed by rotting will be termed "rot degree" (German: "Rottungsgrad") herein; an approximative quantification of this parameter for tree bark can be given by means of color grading: fresh tree bark is brownish to maroon and becomes gradually darker as humic acids are formed by decomposition. Further, as a consequence of the combined effects of mechanical impact upon continued use, and of natural decomposition, tree bark particles of a top layer tend to become smaller by attrition. As a consequence, the interstices of a layer of coarse tree bark particles will tend to become filled by finer particles upon prolonged use so as to increase packing density and reduce water permeability. Accordingly, it has been assumed that an athletic field or playground having a tread-resistant top layer formed of tree bark particles would require replacement of the degraded tree bark material eventually.

OBJECTS OF THE INVENTION

Accordingly, it is a primary object of the invention to provide for an athletic field having an improved top layer of the water-permeable type and wherein the required tread resistance can be achieved with a single tree bark layer and even with a reduced portion of coarse tree bark particles, or with a tree bark material consisting essentially but of fine tree bark particles.

A further object is to provide for an athletic field having a water-permeable top layer of such resilience and low surface friction that the incidence of fall-induced injuries can be significantly reduced.

Yet another object of the invention is an athletic field that can be used during or immediately after rain showers without detrimental water accumulation near the surface and without significant loss of tread resistance.

Still another object of the invention is an athletic field having a tread-resistant, resilient top layer and permitting heavy use while requiring neither high construction costs nor expensive maintenance.

Further objects will assume apparent as this specification proceeds.

SUMMARY OF THE INVENTION

It was found, according to a first aspect of the invention, that tree bark exposed to natural or accelerated decay (e.g. under optimum growth conditions for microbes and fungi) tends to reach a point where its physical and chemical qualities do not show significant decay-induced changes any longer when held under normal ambient conditions that would cause substantial changes of fresh tree bark materials of the same origin. Further, it was found, according to a second aspect of the invention, that water permeability and tread resistance of a top layer structure comprising a high content, e.g. more than 50 % by weight, of fine tree bark particles (e.g. those having a largest particle dimension of less than 2 mm) can be maintained if the top layer is formed, according to the invention, by a mixture of tree bark particles and flexible fibers.

Accordingly, an athletic field or playground as taught by the present invention having an essentially planar and water-permeable surface comprises a top layer that consists, at least in part, of tree bark particles consolidated to form an essentially tread-resistant layer which, in turn, consists, at least predominantly, of a mixture of the tree bark particles and of flexible fibers dispersed therein; further, an at least predominant portion of the fibers should have a fiber length that is at least about equal to the average largest dimension of the tree bark particles. Thus, while the fibers might be a tree bark constituent, they will, according to a generally preferred embodiment of the invention, be added as a discrete second constituent to the top layer composition. In either case the carbon:nitrogen ratio (as explained below) of the tree bark material used preferably is at least about 70.

The terms "consisting at least predominantly" and "an at least predominant portion" are intended to refer to a composition which consists of at least about 50 % by weight of such "predominant" portion.

PREFERRED EMBODIMENTS OF THE INVENTION

According to a first and generally preferred embodiment, a predominant portion, at least, of the tree bark particles forming the top layer of an athletic field or playground has a particle size that permits passage of substantially all particles of the tree bark material through a sieve that has openings of about 50 mm in diameter (sieve size) while an at least predominant portion of the fibers has a length of at least more than about 50 mm (fiber length). In other words, the fibers should generally be longer than the tree bark particles in this embodiment of the invention.

Specifically, in order to achieve a maximum degree of tread resistance in the top layer of an athletic field, a predominant portion, at least, of the fibers should have an average length that is significantly greater than the average largest dimension of the tree bark particles. For example, with typical tree bark particle sizes of 0 to 40 mm, 0 to 50 mm or 10 to 80 mm of use herein the corresponding average fiber length should be above 40 mm, above- 50 mm or above 80 mm, typically in the range of from about;50 to b 15 mm or more. In this context, a tree bark sieve size of 0 to 40 mm, for example, indicates that all components of a given sample will pass through a 40 mm sieve, i.e. one having openings of 40 mm diameter. On the other hand, a sieve size of 10 to 80 mm, for example, indicates that all components of a tree bark sample will be retained on a 10 mm sieve but pass an 80 mm sieve.

Generally, the flexible fibers can be of natural or synthetic origin but should be at least as rot-resistant as the tree bark particles which, in turn, preferably do, but need not, consist of rot-predegraded tree bark, i.e. a tree bark material that has been subjected to natural or artificial biological decomposition so as to be at least partially rotstabilized as explained above.

While advantageous results may be obtained with a fiber content of as low as about 0.01 to about 0.1 %, by weight, of fibers based upon the dry weight of the tree bark particles, a fiber concentration in the range of from about 0.1 to about 5 %, by weight, on the basis just mentioned is preferred for many purposes of the invention. Fiber contents of up to 10 %, by weight, or more may be used but, as a rule, do not significantly improve the critical properties of the resulting top layer any longer, at least not when considering the cost/benefit ratio.

Maintaining a specified fiber concentration range in relation to the surface area of the resulting top layer may be advantageous for many purposes of the invention; for example, at a typical overall thickness of the top layer according to the invention in the range of from about 30 mm to about 200 mm, e.g. from 50 to 150 mm, a preferred fiber concentration will be in the range of from about 50 grams to about 1000 grams of fibers per square meter of the top layer (apparent as "gross" or apparent upper surface area as opposed to a theoretical surface area).

Generally, the term "fiber" as used herein is intended to refer to a flexible elongated structure having any suitable cross-sectional shape and a substantially greater length than thickness, say, being at least about 50 times longer than wide and thick. Preferred fibers have an essentially uniform gauge or diameter in the range of from about 10 microns to about 1 millimeter, e.g. between 0.05 and 0.5 mm; this may be influenced by the wet tensile strength of the fibers, however, in that lower gauges are preferred with higher tensile strength fibers and vice-versa; fiber deniers (insofar as applicable) may be in the range of from 1 to 1000 den. Fibers may be single fibers, staple fibers, monofilaments, yarns (less preferred) or fiber bundles (less preferred) and may have a natural or artificial texture.

Vegetable fibers commonly called "hard fibers", such as coconut fibers, are a representative example of a first type of preferred fibers. Staple fibers made of polyesters or polyalkylenes and having an average length of from about 50 to about 150 mm are a representative example of another type of preferred fibers. Generally, the fibers used in mixture with the tree bark particles should be at least as rot-resistant as the tree bark particles. For example, no rot-induced decomposition effects should be apparent on the fibers after 12 months of having been kept under normal weather conditions and in admixture with moist tree bark particles.

The above mentioned natural or synthetic organic fibers will have the required flexibility per se. While mineral fibers can be used in tree bark mixtures according to the invention, non-flexible, i.e. brittle, fibers should not be used as the major fiber constituent. A simple test for suitable fiber flexibility involves bending a single fiber onto itself, i.e. by a sharp turn of 180 degree. A fiber that will not break under repeated bendings upon itself is assumed to be flexible in the sense used herein.

Tree bark stability against biological decomposition produced by a pre-rotting treatment or due to an inherently more resistant tree bark material can frequently be expressed in terms of the ratio of its (elemental) carbon content to its (elemental) nitrogen content in the sense that a higher carbon:nitrogen ratio (C:N ratio) is indicative of a relatively higher rot stability. According to a preferred general aspect of the invention the top layer of an athletic field is formed of a tread-resistant tree bark layer having a C:N ratio of at least about 70 and preferably at least about 100. For illustration, a C:N ratio of 100 indicates that conventional elemental analysis of a tree bark material having such a C:N ratio will yield but one part, by weight, of chemically bound nitrogen per 100 parts, by weight, of chemically bound carbon.

While not wishing to be bound by any specific theory, it can be assumed that a substantially less rot-resistant cellulose component of the original tree bark will be preferentially decomposed by the microorganisms so as to leave a rot-stabilized "residue" bark material having a substantially increased lignin content. In other words, high lignine contents as evidenced, e.g. by the C:N ratio or similar analytical criteria, are generally preferred in a particulate organic material for use as a top layer of athletic fields.

In line with this aspect, it is preferred for many embodiments of the invention if the tree bark material used for the top layer has undergone significant pre-rotting as evidenced by a dark-brown humic acid coloration typically having a darkness value as explained below in the range of from D4 to D6.

The provenience of the tree bark from a particular tree species may have some impact when using fresh tree bark but is not believed to be overly critical if a pre-treated (i.e. by natural or artificial rot-type biological decomposition treatment) bark material is used. Pine tree bark is a frequently preferred example and bark mixtures of differing trees may be used, of course. For example, particulate bark mixtures containing about one third, by weight, of bark from fir trees and about two thirds, by weight, of bark from pine trees have been found to be suitable. However, it is a particular advantage of the invention that tree bark of substantially any provenience can be used for the top layer; since bark is normally regarded as a waste or by-product of timber production, the invention may help to increase the profitability of timber operations by selling the tree bark as a valuable construction material for athletic fields and similar constructions.

Generally, rot resistance of a given tree bark or fiber material can be tested in an accelerated test by storing the sample in an oven kept at 35° C in the presence of humidity (96 % relative humidity) and with the normal spectrum of aerobic/anaerobic rot-inducing microorganisms that will be present in the natural soil of a forest; significant changes, e.g. of the color and/or attrition strength of the tested particles within a predetermined period of time, e.g. within 30 or 60 days, indicates a lower rot resistance. In practice, relative measurements will normally be sufficient in that the fibers should not be substantially less rot-resistant than the tree bark particles, and in that a tree bark material that has been stabilized be pre-rotting as described herein will show little if any substantial change upon accelerated testing and is preferred for many purposes of the invention.

For standardization, comparative color measurements may be made to establish a minimum degree of rot-induced stabilization of tree bark; for example, German Industry Standards (DIN 6164) provide for color standards, and a generally acceptable rot-induced degree of decomposition of tree bark suitable for the invention corresponds to a "DIN darkness value D" of at least about 3 (low rot-degree) and preferably in the range of D4 to D6. Fresh bark frequently has a D-value of 1 or 2. It will be appreciated that the age of trees may play a role in that rot stabilization tends to start in the bark of living trees and such bark- while being "fresh" in a production sense - may be pre-decomposed and hence rotstabilized as preferred for use in the present invention. It is assumed in the art that the darkness of a tree bark material is determined to an essential degree by formation of humic acid; hence, the dark brown-to-blackish color that is typical for formation of humic acids in peat and the like biologically degraded plant materials is an indication of a generally suitable particulate tree bark material.

Artificial rot treatment of tree bark is known per se in the art of processing tree bark and generally involves collection and closed deposition of tree bark in the presence of natural rot-inducing microorganisms, and of humidity, generally at autogenic elevated temperatures of from about 50 to about 80° C. The degree of rotting can be controlled by the length of the treatment. Typically, a rot-stabilized tree bark material can be obtained by such treatment within periods of typically from 1 to 40 weeks.

Alternatively, tree bark material obtained from open deposits may be used and it is within the ambit of the present invention to re-use tree bark from an established field after suitable sieving and/or mixing.

Blending or mixing of tree bark and fibers to produce the preferred mixture for top layers as disclosed herein can be effected by methods known per se in the art. Fibers can be pre-blended with particulate bark material prior to spreading of the mixture onto a supporting field structure, e.g. by conventional blenders for batchwise or continuous interblending of construction materials.

Alternatively, fibers may be worked into a previously spread layer of tree bark particles. High mixing intensities are not required and may even be detrimental when using relatively long fibers. Blending times in the range of from about 10 to about 30 minutes are believed to be typical for normal batches.

The degree of distribution of the fibers in a tree bark top layer according to the invention can and should be controlled by taking appropriate samples of the field under construction and by washing out the tree bark material. Generally, a mean deviation of not above about 20 % is believed to be acceptable when taking about 10 samples at mutually distanced points of a field. However, no particular preferred orientation of the fibers within the top layer is believed to be critical, and it is assumed that best overall properties of the top layer will be achieved if the fibers are selected and distributed in the mixture so as to simulate a random structure similar to that of natural grass roots. However, it is not precluded herein to use fibers in an oriented distribution in combination with the tree bark material. For example, a pre-formed mat or loose carpet-type fiber structure could be used to form a fiber skeleton in a top layer made of particulate tree bark according to the invention.

In any case, an essential criterion is to obtain a surface property of the top layer such that its resistance to the movement of persons running at maximum speed on such layer is not significantly higher than that of a conventional athletic field having a well cared top layer of natural grass cut and rolled in the conventional manner.

In many important uses of the invention, e.g. training fields for football, rugby or soccer teams, the field's top layer will consist of at least 50 %, by weight, of tree bark, e.g. from about 75 to about 95 %, by weight, of moist tree bark particles. In addition to the fibers it may contain a minor portion of a particulate mineral constituent, e.g. 0 to 20 %, by weight, of sand or particulate mineral ash having a sieve size of, say, 0 to 1 mm or 0.5 to 2 mm. While fresh tree bark material is not a preferred main constituent of the top layer of a field that is required to have a high initial tread resistance and a high initial degree of compaction (void portion typically less than about 50 %, by volume), it can be used as a minor constituent.

A preferred method of building an athletic field or playground according to the invention includes providing a conventional ground structure with a bedding layer and a drainage system layer; specific examples and standard methods of constructing a suitable ground structure are disclosed in the above mentioned European Patent 0 096 908 to Applicants and will not be set forth in detail herein.

Generally, such a ground structure may include a ground plane graded in a conventional manner. An inclination or curvature of the bottom stratum is not required except where needed for inclination of drainage tubes that are placed directly on that stratum. In that case, the next or one of the next mineral layers below the top will in general be graded for planity (zero-inclination) of the top layer. Since the top layer also will be essentially planar in most cases, water removal in the sub-stratum or substrate below the tree bark top layer should be ascertained by an effective drainage system involving inclined tubes for gravity drainage and/or suction means, such as pumps.

Drainage pipes can be provided directly on the surface of the bottom stratum or may be embedded within a superimposed filtering layer (of a granular mineral material) which may be topped or even replaced by a conventional geotextile layer. A supporting layer of a granular mineral material, normally a sand/gravel mixture, will be spread on the drainage tubes or on the filter layer or geotextile, and should have a stable structure of voids to permit complete and fast passage of water. This is conventional, of course, for prior art fields with a water-permeable top layer and thus, again, requires no detailed discussion.

A so-called dynamic layer of a granular mineral layer may be applied on top of the supporting layer, i.e. immediately below the top layer, but this is optional and may depend upon conditions of maximum costs, climatic parameters, etc. in the same manner as with conventional water-permeable top layer structures of athletic fields.

In any case, the top layer of an athletic field according to the invention will generally be formed of one or more layers of a particulate tree bark material preferably having the above specified C:N ratio and/or including flexible fibers in addition to the tree bark particles and in admixture therewith as explained above. Preferably, the tree bark layer is applied as a moist or water-saturated mixture and/or is water-saturated after its application before or after compaction, such as by rolling with machines of the type used in road construction. The term "water-saturated" as used herein indicates a mixture containing water in such an amount that the mixture, after being placed on a coarse sieve, gives off water at the same rate at which it is added to the mixture. A less than water-saturated mixture, on the other hand, would be capable of absorbing water.

Normally a moist mixture will contain at least about 10 %, by weight of the dry constituents, of water while a typical saturated tree bark mixture will contain about 50 to 80 % of water.

While the top layer of tree bark may be formed as a single stratum, structures formed of two or more superimposed layers of tree bark particles may provide additional tread resistance. For example, a relatively thick (50 to 120 mm) lower layer of a relatively coarse (particle size 0 to 50 mm) tree bark/fiber mixture may be covered with a relatively thin (20 to 40 mm) upper layer of relatively fine tree bark particles, e.g. containing up to 50 %, by weight, or more of particles having a sieve size of 0 to 2 mm. Tests made by Applicants indicate that even in case of a top layer made but of fine tree bark particles, the resulting water permeability will depend primarily upon the water-removing capacity of the ground structure, i.e. the drainage installations thereof, and not upon the tree bark layer.

As briefly mentioned above, the tree bark mixture or the top layer(s) formed therefrom may include—in addition to the preferred flexible fibers—minor amounts of further components, such as sand; it should be ascertained, however, that any such addition will not separate out of the mixture with the tree bark upon normal use nor be leached out by rain water. Laboratory tests made with the present top layer structures indicate that the tree bark mixtures will not only show no negative effects upon ground-water but will have a significant effectiveness as a biological water filter. Accordingly, an athletic field according to the invention could be of use in emergency situations, e.g. a fire in an industrial plant nearby, for cleaning of polluted water.

Further, laboratory tests with the preferred tree bark-/fiber mixtures have shown that topical changes of the water permeability of a tree bark top layer in areas of an atypically heavy mechanical stress, e.g. around a soccer goal, will not occur even though a more than average diminution of the tree particle size might occur in such areas. As is well known in the art, formation of rain puddles in heavy used areas of athletic fields is a problem hitherto unsolved satisfactorily, and it is another advantage of the invention that water-puddle formation can be safely eliminated in athletic fields according to the invention. Generally, a tree bark mixture consisting of rot-stabilized tree bark particles having a sieve size of 0 to 30 mm in admixture with about 0.5 % (dry weight basis) of the preferred fibers will show no puddle formation in field surface areas of maximum use intensity.

Sieve numbers given herein for the granular tree bark material can be achieved and controlled by standard sieving methods, e.g. Swiss Industrial Standards (SN) for road constructing industries, specifically SN 670808 (sieves), SN 670810B (sieve test), SN 670812A (dry sieving) and SN 670814B (wet sieving); since these methods are normally applied for analysis of mineral materials, some modifications in view of different specific or apparent densities and of strength parameters may be required but are believed to be well within the knowledge of one experienced in the art; for example, significant particle attrition by sieving should be avoided, e.g. by limiting the time of operation of the sieving machines or by resorting to wet sieving whenever dry sieving causes an essential change of the actual particle sizes in a sample. Few and simple tests for optimization and standardization may be required in view of differences between tree bark materials that are available at a given site and the typical materials described herein.

For determination of the C:N ratio, standard methods of elemental analysis can be used, e.g. combustion of the dry tree bark material, nitrogen determination according to Kjeldahl, and carbon determination via carbon dioxide. The term "dry weight" as used herein generally refers to a particulate tree bark material that has been dried to constant weight in an aerated oven at 105° C, Weight constance sufficient for the present purposes will normally be achieved within about 24 hours. As mentioned above, a high lignin content of the tree bark and the fibers is believed to be preferable.

Now, while the proportionate lignin content of the tree bark material can, and preferably is, increased by controlled pre-rotting as discused above, natural fibers used for the mixture with tree bark should preferably have a relatively high rot-resistance per se and this is the case with natural plant fibers that have a lignin content of at least about 10 %, by weight, and preferably in the range of from 10 to 50 %, by weight, or more. Suitable methods for chemical determination of the lignin content of both the fibers and the tree bark are known and can be used herein. Representative methods are those disclosed by Haegglund, E. in "Holzchemie", 2nd Edition, page 225, or by Halse, 0. M., in "Papier-Journalen", Vol. 10 (1926), page 121.

EXAMPLE 1

An athletic field for use as a regular soccer training field was built as disclosed in the above mentioned European Patent No. 0 096 908 except that the top layer was made of a mixture containing, per cubic meter of bark material (dry weight about 250 kg, sieve size 0 to 50 mm), 1300 grams of conventional coconut single fibers, a commercially available product for use in making mats, brushes or the like. The bark had a C:N ratio of about 100 and the mixture of bark and fibers was applied as a single top layer of about 100 mm thickness, rolled and saturated with water. The blender used for incorporation of the fibers into the bark material was a barrel mixer for continuous operation.

EXAMPLE 2

Example 1 was repeated except that the top layer was applied in two subsequent steps. The lower stratum of the top layer was made of the fiber/tree bark mixture of Example 1 and applied at a thickness of 80 mm while the second or upper stratum consisted but of rot-stabilized tree bark having a sieve size of 0 to 20 mm and was applied at a thickness of 20 mm. The second layer was layed onto the uncompacted lower layer, and compaction was effected by commonly rolling both strata with subsequent water saturation of the resulting top layer.

EXAMPLE 3

For purposes of comparative testing various bark/fiber mixtures were applied in patches onto a conventional water-permeable supporting structure without top layer; the test patches each had an area size of about 1 square meter. Each patch was provided in a manner essentially as described in Example 1 with different mixtures containing particulate tree bark material of a given degree of rot-stabilization and with differing fiber contents. After saturation with water, tread resistance and water-permeability of each test area were tested in the following manner:

Water-permeation testing involved pouring of about 50 litres of water as quickly as possible onto the test site and measuring the time until the "Water mirror" or film that was formed initially on the surface had disappeared. Periods of less than 300 seconds until disappearance of the mirror effect were judged to have "good water-permeability"; periods of above 500 seconds until disappearance of the water mirror were judged to have "poor water-permeability".

Tread resistance was tested by putting a single soccer shoe (with standard length protrusions) under a load of 40 kilograms onto the test site surface and by sidewise inspection of the interface between the shoe and the top layer surface under daylight conditions for passage of light. If passage of light could be observed between the sole and the top layer surface, the latter was judged to be "tread-resistant".

Mixtures of (A) completely rot-stabilized tree bark material (sieve size 0 to 50 mm) and at least about 0.5 % by weight (dry weight) of coconut fibers;

(B) partially rot-stabilized tree bark material (sieve size 0 to 50 mm) and at least 0.2 %, by weight, of coconut fibers; as well as (C) the above mixture (A) plus a 10 %, by weight, addition of quartz sand (based upon the combined dry weights of all constituents of the mixture)

all yielded water-permeable and tread-resistant top layers.

When increasing the fiber portion to about 2 %, both the water-permeability and the tread resistance improved significantly. At a fiber content of above 2 % neither the water-permeability nor the tread resistance showed significant changes while the overall coherence of the top layer continued to increase.

The advantages of the present invention, as well as certain changes and modifications of the disclosed embodiments thereof, will be readily apparent to those skilled in the art. It is the Applicants' intention to cover by their claims all those changes and modifications which could be made to the embodiments of the invention herein chosen for the purpose of the disclosure without departing from the spirit and scope of the invention.

Protection by Letters Patent of this invention in all its aspects as the same are set forth in the appended claims is sought to the broadest extent that prior art allows.

What is claimed is:

1. An athletic field or playground having an essentially planar and water-permeable surface consisting, at least in part, of tree bark particles consolidated to form an essentially tread-resistant top layer of said field or playground; said top layer consisting, at least predominantly, of a mixture of said tree bark particles having an average largest dimension and of flexible fibers dispersed in said mixture; and wherein an at least predominant portion of said fibers has a fiber length that is at least as great as the average largest dimension of said tree bark particles.

2. The athletic field or playground of claim 1 wherein a predominant portion, at least, of said tree bark particles has a particle size permitting passage of substantially all particles through a sieve having uniform openings of about 50 mm in diameter, and wherein a predominant portion of said fibers has a length of more than about 50 mm.

3. The athletic field or playground of claim 1 wherein said fibers are at least as rot-resistant as said tree bark particles.

4. The athletic field or playground of claim 3 wherein said tree bark particles consist, at least in part, of rot degraded tree bark.

5. The athletic field or playground of claim 1 wherein said fibers comprise from about 0.01 to 10 %, by weight, of said tree bark particles in said mixture, based upon the dry weight of said particles, and wherein said top layer has a thickness of from about 30 to about 200 mm and a content of said fibers of from about 50 to about 1000 grams of said fibers per square meter of said top layer.

6. The athletic field or playground of claim 1 wherein said fibers have substantially uniform diameters of from about 0.01 to 1 mm.

7. The athletic field or playground of claim 1 wherein said tree bark particles have a carbon:nitrogen ratio of at least about 70.

8. The athletic field or playground of claim 1 wherein said tree bark particles have a rotting degree corresponding to a dark-brown humic acid coloration.

9. The athletic field or playground of claim 1 wherein said fibers are comprised, at least in part, of vegetabilic hard fibers or/and of organic man-made fibers

10. An athletic field having an essentially planar and water-permeable surface layer consisting, at least predominantly, of tree bark particles consolidated to form an essentially tread-resistant top layer; said tree bark particles having a carbon:nitrogen ratio of at least about 70.

11. The athletic field of claim 10 wherein said tree bark particles have a carbon:nitrogen ratio of at least about 100.

12. A method of building an athletic field or playground having an essentially planar and water-permeable surface provided on a supporting ground structure; said surface comprising tree bark particles which have been consolidated to form an essentially tread-resistant top layer; said method comprising the step of forming said top layer from a mixture of tree bark particles having an average largest dimension and of flexible fibers distributed therein; wherein an at least predominant portion of said fibers has a fiber length that is greater than the average largest dimension of said tree bark particles.

13. The method of claim 12 wherein a moist mixture of a rot degraded tree bark material and said fibers is shaped to form a top layer or top layer portion.

14. The method of claim 12 wherein water is incorporated into said mixture to the point of water saturation thereof.

15. The method of claim 13 wherein said moist mixture contains more than 10 %, by weight, of water.

16. The method of claim 14 wherein said saturation amounts to a water content of at least about 40 %, by weight, of said mixture.

17. A method of building an athletic field or playground having an essentially planar and waterpermeable surface provided on a supporting ground structure; said surface comprising tree bark particles which have been consolidated to form an essentially tread-resistant top layer; said method comprising the step of forming said top layer from tree bark particles that have a carbon:nitrogen ratio of at least about 70.

* * * * *

UNITED STATES PATENT AND TRADEMARK OFFICE

CERTIFICATE OF CORRECTION

PATENT NO. : 4,900,010

DATED : February 13, 1990

INVENTOR(S) : Bernd WENGMANN et al

It is certified that error appears in the above-identified patent and that said Letters Patent is hereby corrected as shown below:

IN THE SPECIFICATION:

Column 3, line 67, "assume" should be --apparent--.

Column 4, line 63, "50 to b 15 mm" should be --50 to 150 mm--.

Column 9, lines 30 and 40, "bark-/fiber" should be --bark/fiber--.

Column 10, lines 13 and 14, "105° C," should be --105° C.--.

Signed and Sealed this

Twenty-sixth Day of March, 1991

*Attest:*

HARRY F. MANBECK, JR.

*Attesting Officer*

*Commissioner of Patents and Trademarks*